United States Patent [19]

Muccigrosso et al.

[11] 4,177,399

[45] Dec. 4, 1979

[54] HIGH CONTRAST CATHODE RAY DISPLAY TUBE

[75] Inventors: Vincent J. Muccigrosso, Elmira; John L. Nivison, Elmira Heights; Albert E. Oberg, Horseheads, all of N.Y.

[73] Assignee: Westinghouse Electric Corp., Pittsburgh, Pa.

[21] Appl. No.: 909,416

[22] Filed: May 25, 1978

[51] Int. Cl.[2] ..... H01J 29/20; H01J 29/89

[52] U.S. Cl. ..... 313/368; 313/478; 313/480; 313/112; 358/253

[58] Field of Search ..... 313/474, 480, 468, 478, 313/477, 112; 358/253

[56] References Cited

U.S. PATENT DOCUMENTS

| | | | |
|---|---|---|---|
| 2,618,759 | 11/1952 | Hoyt | 313/474 |
| 2,690,554 | 9/1954 | Wolf | 313/474 X |
| 2,734,142 | 2/1956 | Barnes | 313/480 X |
| 3,143,683 | 8/1964 | Duncan et al. | 313/480 X |
| 3,382,393 | 5/1968 | Schwartz | 313/468 X |
| 3,873,868 | 3/1975 | Robinder | 313/112 |
| 3,879,627 | 4/1975 | Robinder | 313/112 |
| 3,946,267 | 3/1976 | Lustig et al. | 313/474 X |
| 3,950,668 | 4/1976 | Mattis et al. | 313/468 |

*Primary Examiner*—Palmer C. Demeo

*Attorney, Agent, or Firm*—W. G. Sutcliff

[57] ABSTRACT

A high contrast cathode ray display tube is provided by using a color filter glass faceplate for the tube which has a narrow band of transmissivity which closely matches the display phosphor emission.

1 Claim, 3 Drawing Figures

HIGH CONTRAST CATHODE RAY DISPLAY TUBE

BACKGROUND OF THE INVENTION

The present invention relates to cathode ray display tubes which exhibit high contrast and are thus readable by a viewer with high ambient light levels, such as bright sunlight. The brightness of the phosphor screen does affect the viewing under such conditions, but even more important is the contrast between the activated phosphor areas and the reflected ambient light from the unactivated phosphor areas which determines the readability of the display.

Numerous techniques have been practiced to reduce the light reflection from the tube faceplate and to thereby improve contrast. These include the use of anti-reflective coatings on the outer faceplate surfaces, and the use of dark, low neutral density transmissivity glass as the faceplate to reduce the reflected light level. Recently, color selective laminated panels whose peak transmission color coincides with the emission color of the phosphor screen have been placed on the exterior of the tube faceplate. The use of such laminated color selective panels adds to the manufacturing costs of the tube.

The contrast ratio of a cathode ray display tube is the luminance of the displayed information divided by the luminance (B) of the area immediately surrounding it. The luminance of the displayed information is the sum of the phosphor excitation luminance (S) and the surrounding area luminance (B). The contrast ratio is then:

$$C=S+B/B \text{ or } C=1+S/B.$$

In some applications a factor termed contrast is defined as $C-20 \log (1+S/B)$. The contrast ratio or contrast of a tube is determined by measuring the luminance (S) in subdued light with the tube operating at some specified level. The luminance (B) is determined with the tube off by measuring its luminance caused by diffuse reflection of light of a specified intensity incident at a specified angle to avoid any contribution from specular reflection.

The advantage of a filter glass is that it has a relatively high transmission of the phosphor light compared to the incident ambient white light. Thus, for a given tube operating level and phosphor input energy a higher (S) is obtained or conversely for a given (S) less input energy to the phosphor is required, resulting in longer tube life and performance.

SUMMARY OF THE INVENTION

An improved high contrast cathode ray display tube is provided by use of a tube faceplate glass which is a color filter glass which has a narrow band of transmissivity which closely matches the display phosphor emission. A specific color filter glass and phosphor combination is set forth wherein the peak transmissivity of the narrow band of transmissivity for the glass is approximately at the wavelength of peak phosphor emission.

DESCRIPTION OF THE PREFERRED EMBODIMENT

Figure 1:
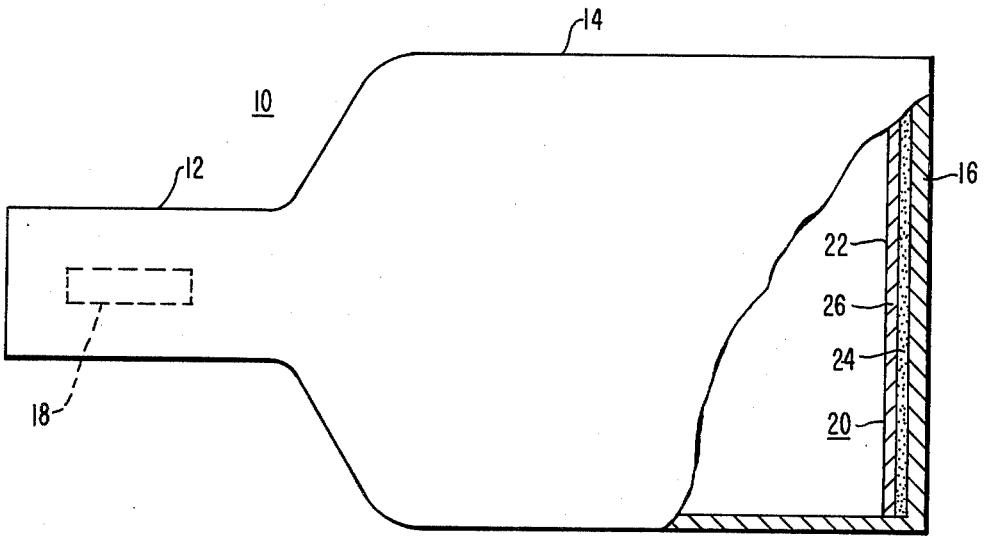
FIG. 1 is a side elevation view in section of a cathode ray display tube of the present invention.
Figure 2:
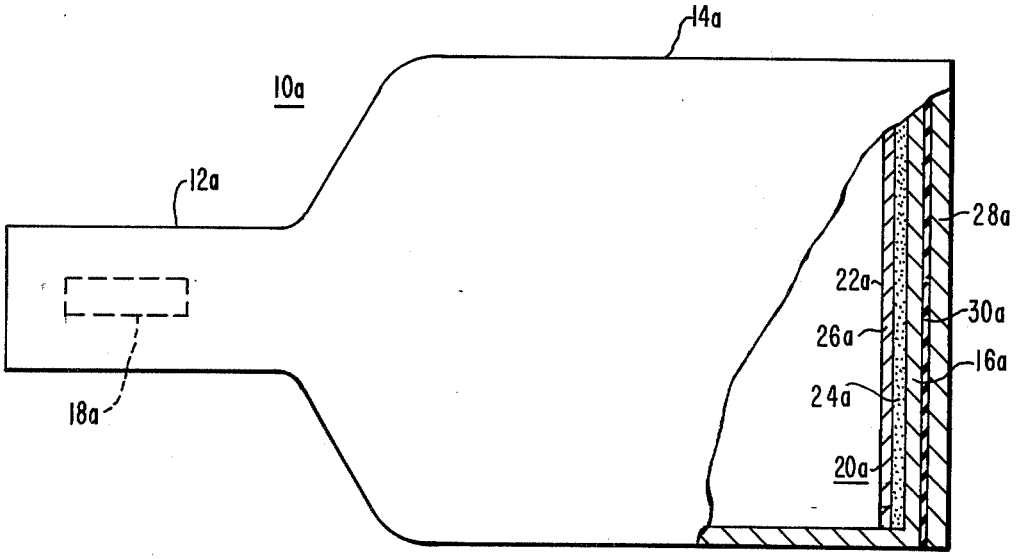
FIG. 2 is a side elevation view in section of another embodiment cathode ray display tube of the present invention.

The present invention is best understood by reference to the exemplary embodiment seen in FIGS. 1 and 2. The cathode ray display tube 10 is seen in FIG. 1, and comprises a neck portion 12, a funnel portion 14, and a faceplate portion 16. An electron gun 18 is shown represented schematically in the neck portion 12 as is well known. A phosphor screen 20 is disposed on the interior surface 22 of the faceplate portion 16. The phosphor screen 20 comprises a thin uniform phosphor layer 24 disposed on the faceplate interior surface 22, with a thin electron transmissive anode electrode layer 26 disposed uniformly on the phosphor layer. This thin anode electrode layer 26 is typically an aluminum film, as is well known in the art.

Figure 3:
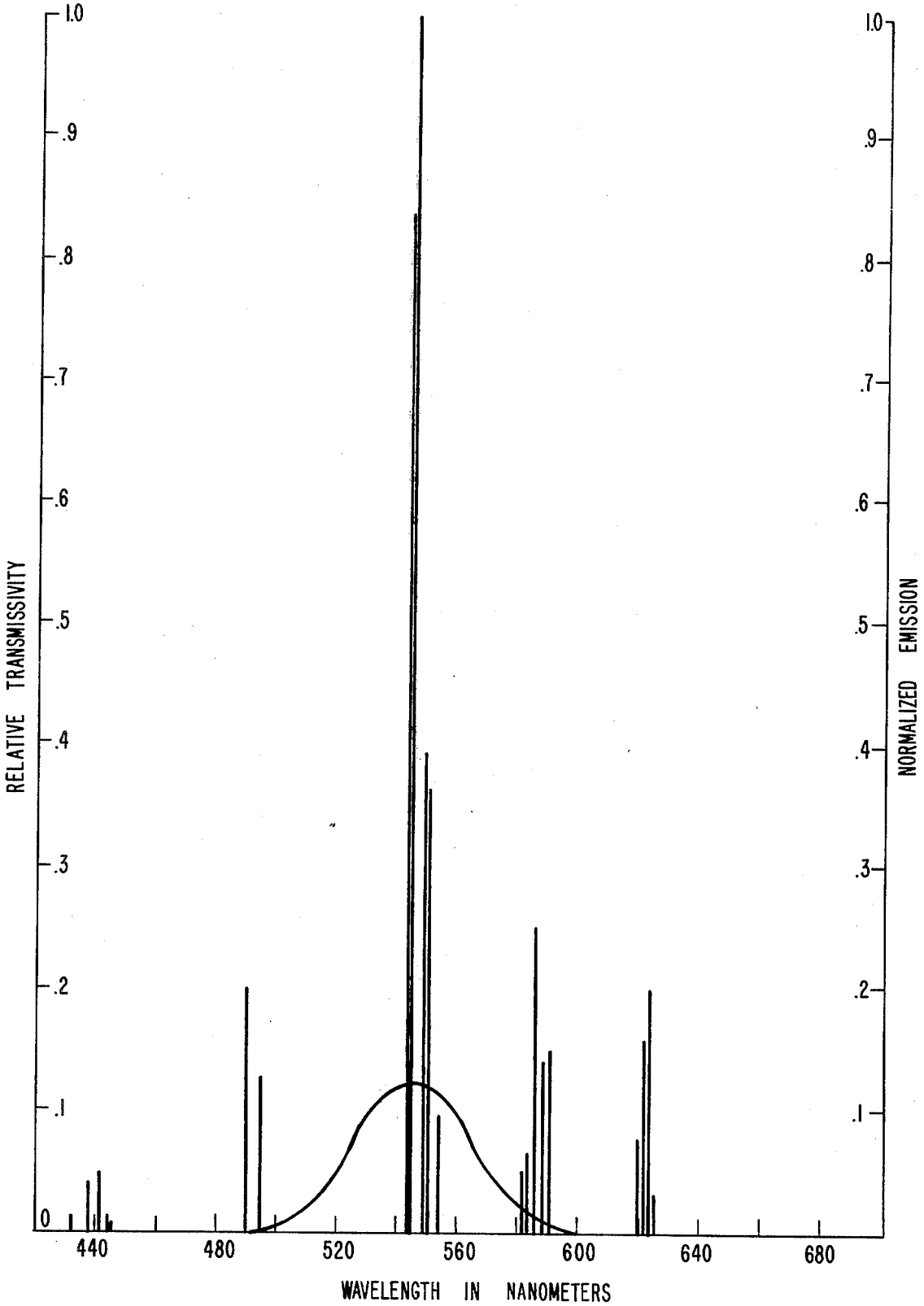
FIG. 3 is a plot of the cathodoluminescent line emission of one phosphor embodiment in which normalized emission intensity is plotted against wavelength, and super-imposed is a transmissivity curve for one faceplate color filter glass embodiment wherein transmission is plotted against wavelength.

In the present invention the phosphor layer is formed of a phosphor material in which the cathodoluminescent emission is concentrated in several closely spaced lines or as a narrow band. A specific phosphor material which can be used is terbium activated gadolinium oxysulfide, which is designated as P-43 phosphor by the Joint Electron Devices Committee of the IEEE. The emission characteristics of this phosphor are shown in FIG. 3, wherein normalized emission is plotted against wavelength. This phosphor is a line emitter, with the peak line at about 545 nanometers being normalized to a value of 1. As can be readily seen, the strongest emission lines for this phosphor are concentrated in a narrow band approximately between 540–550 nanometers. A high percentage of the total emission energy from the phosphor is concentrated at emission lines in this narrow band.

The faceplate portion 16 of the tube 10 is here a flat planar faceplate sealed to the end of the cylindrical funnel portion 14. The faceplate portion 16 is formed of a color filter glass which exhibits a narrow band of transmissivity which closely matches the display phosphor emission. A green filter glass type S-8006 available from Schott Optical Glass, Inc., Duryea, Pennsylvania is used as the tube faceplate. The transmission characteristic of this green filter glass for a glass thickness of 5.3 millimeters is seen in detail in FIG. 3, superimposed on the phosphor emission lines. As can be seen in the plot of transmissivity versus wavelength, the green filter glass has a relatively low absolute transmissivity, peaking at about 0.125, and the transmission band is narrow and peaks at about 545 nanometers with a transmissivity value of above 0.1 over the narrow range of 532 to 558 nanometers.

The transmissivity of the green filter glass faceplate thus closely coincides with the phosphor emission, with the peaks being approximately at the same wavelength. This optimizes transmission of the green display image from the phosphor screen, while not transmitting any ambient light other than that in the narrow band of transmission of the faceplate glass. This produces a significantly improved contrast display in bright sunlight as well as in high brightness artificial lighting.

The transmission characteristics of such color filter glasses is such that transmissivity is approximately linear with thickness, with increasing transmissivity at reducing thickness. The plot of transmissivity of FIG. 3 is for glass which is 5.3 millimeters thick. Another color filter glass type S-8005, available from the same glass supplier identified above, also can be used with the same phosphor since it also exhibits a narrow transmissive band peaking approximately at about 545 nanometers but has a lower transmissivity. Other filter glasses which exhibit a narrow transmission band can be coupled with phosphor which have a closely matched narrow emission band or line.

In another embodiment of the invention seen in FIG. 2, the cathode ray tube 10*a* includes a neck portion 12*a*, funnel portion 14*a*, and faceplate portion 16*a*. The electron gun 18*a* and phosphor screen 20*a* are described for the embodiment of FIG. 1. The faceplate portion 16*a* is fabricated of a glass which has relatively narrow transmission bandwidth, with a peak transmission of 0.5 at about 545 nanometers. A neutral density filter panel 28*a* is laminated to the exterior surface of the faceplate 16*a* with a laminating resin layer 30*a* therebetween. This laminating resin layer 30*a* has approximately the same index of refraction as the glass faceplate and by way of example is about 0.10 inch thick. A neutral density filter transmits at a uniform level across the visible spectrum. In general, standard glass is approximately 92% transmissive over the visible spectrum. The neutral density filter 28*a* can have a transmissivity of from about 30 to 65 percent, with the filter transmission selected to be compatible with the tube type. More particularly for a tube which has a high electron current capacity and high phosphor screen luminance the neutral density filter transmissivity is preferably lower to optimize contrast while still permitting reasonable screen viewing brightness. For a tube with low electron current capacity and correspondingly low phosphor screen luminance, the neutral density filter should be high at about 65 percent to ensure that the viewing brightness is adequate while still having improved contrast.

In yet another embodiment, a contrast enhancement panel which has a concave spherical exterior surface can be disposed on the color filter glass faceplate of the cathode ray tube of the present invention. Such a contrast enhancement panel is described in copending application S/N 811,746, filed Dec. 16, 1977 and owned by the assignee of the present invention. The concave spherical exterior surface of this panel is designed so that the center of curvature coincides with the normal viewer position, so that ambient light from other areas is not reflected back to this viewer position.

We claim:

1. A cathode ray display tube with improved contrast for viewing the display in high ambient light levels wherein the tube includes a display faceplate portion with a display screen phosphor layer on the interior surface of the faceplate portion, the improvement wherein the tube faceplate portion is formed of a glass which is a green color filter glass of low relative transmissivity of at least 0.1 over the range of 532 to 558 $\mu$m, and the transmissivity of the color filter glass peaks at about 0.125 at about 545 $\mu$m, and the phosphor layer is terbium activated gadolinium oxysulfide which exhibits cathodoluminescent emission such that a high percentage of the total phosphor emission energy is concentrated between 540–550 $\mu$m and within the narrow range of wavelength for which the glass transmissivity peaks.

* * * * *